US008159478B2

(12) United States Patent
Ozaki et al.

(10) Patent No.: US 8,159,478 B2
(45) Date of Patent: Apr. 17, 2012

(54) DISPLAY DEVICE AND ELECTRONIC DEVICE USING THE SAME

(75) Inventors: Tadafumi Ozaki, Gifu (JP); Masami Endo, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 870 days.

(21) Appl. No.: 11/568,892

(22) PCT Filed: Sep. 26, 2005

(86) PCT No.: PCT/JP2005/018216

§ 371 (c)(1),
(2), (4) Date: Sep. 29, 2008

(87) PCT Pub. No.: WO2006/035953

PCT Pub. Date: Apr. 6, 2006

(65) Prior Publication Data

US 2009/0015604 A1 Jan. 15, 2009

(30) Foreign Application Priority Data

Sep. 27, 2004 (JP) ..... 2004-279600

(51) Int. Cl.
*G09G 5/02* (2006.01)

(52) U.S. Cl. ..... 345/204

(58) Field of Classification Search ..... 345/694, 345/619, 103, 204
See application file for complete search history.

(56) References Cited

U.S. PATENT DOCUMENTS

| | | | |
|---|---|---|---|
| 5,844,534 | A | 12/1998 | Okumura et al. |
| 5,990,629 | A | 11/1999 | Yamada et al. |
| 6,025,822 | A | 2/2000 | Motegi et al. |
| 6,222,515 | B1 | 4/2001 | Yamaguchi et al. |
| 6,340,970 | B1 | 1/2002 | Furuhashi et al. |
| 6,376,345 | B1 | 4/2002 | Ohashi et al. |
| 6,458,674 | B1 | 10/2002 | Ohashi et al. |

(Continued)

FOREIGN PATENT DOCUMENTS

EP 0 484 159 A2 5/1992

(Continued)

OTHER PUBLICATIONS

International Search Report (Application No. PCT/JP2005/018216) dated Dec. 27, 2005 (3 pages).

(Continued)

*Primary Examiner* — Quan-Zhen Wang
*Assistant Examiner* — Tony Davis
(74) *Attorney, Agent, or Firm* — Fish & Richardson P.C.

(57) ABSTRACT

According to the invention, a compact and inexpensive with low power consumption memory and low access speed can be used for a panel controller and a deterioration compensation circuit of a display device. In a display device of a digital gray scale method, a plurality of pixels of a display panel are divided into first to n-th pixel regions (n is 2 or more) and a format converter portion of a panel controller converts the format of only video data corresponding to one of first to n-th pixel regions and writes the data to one of first and second video memories in each frame period. A display control portion reads out video data that is converted in format and corresponds to one of first to n-th pixel regions in which video data is written to the other of the first and second video memories in the preceding frame period, and transmits the data to the display panel.

16 Claims, 11 Drawing Sheets

U.S. PATENT DOCUMENTS

| | | | | |
|---|---|---|---|---|
| 6,531,400 | B2 | 3/2003 | Ohashi et al. | |
| 6,611,108 | B2 | 8/2003 | Kimura | |
| 6,646,629 | B2 | 11/2003 | Furuhashi et al. | |
| 6,800,557 | B2 | 10/2004 | Ohashi et al. | |
| 6,924,824 | B2 | 8/2005 | Adachi et al. | |
| 2001/0035849 | A1 | 11/2001 | Kimura et al. | |
| 2001/0035863 | A1 | 11/2001 | Kimura | |
| 2002/0024508 | A1 | 2/2002 | Nakamura et al. | |
| 2002/0033783 | A1 | 3/2002 | Koyama | |
| 2002/0063675 | A1 | 5/2002 | Furuhashi et al. | |
| 2002/0105279 | A1* | 8/2002 | Kimura | 315/169.3 |
| 2003/0174153 | A1 | 9/2003 | Koyama | |
| 2004/0090404 | A1 | 5/2004 | Endo et al. | |
| 2004/0152298 | A1 | 8/2004 | Ohashi et al. | |
| 2004/0174384 | A1* | 9/2004 | Ochiai et al. | 345/619 |
| 2004/0222962 | A1* | 11/2004 | Hirakata | 345/103 |
| 2005/0270254 | A1 | 12/2005 | Ozaki | |
| 2006/0011846 | A1 | 1/2006 | Ozaki | |
| 2006/0181490 | A1* | 8/2006 | Ozaki | 345/76 |

FOREIGN PATENT DOCUMENTS

| | | | |
|---|---|---|---|
| EP | 1 094 438 | A1 | 4/2001 |
| EP | 1 187 087 | A1 | 3/2002 |
| JP | 04-116688 | | 4/1992 |
| JP | 04-291395 | | 10/1992 |
| JP | 05-027705 | | 2/1993 |
| JP | 05-072998 | | 3/1993 |
| JP | 08-086998 | | 4/1996 |
| JP | 11-259046 | | 9/1999 |
| JP | 2001-343924 | | 12/2001 |
| JP | 2002-006808 | | 1/2002 |
| JP | 2002-014653 | | 1/2002 |
| JP | 2002-175039 | | 6/2002 |
| JP | 2002-175041 | | 6/2002 |
| JP | 2004-163919 | | 6/2004 |
| WO | WO 98/33165 | | 7/1998 |
| WO | 2004/036534 | A1 | 4/2004 |

OTHER PUBLICATIONS

PCT Written Opinion of the International Searching Authority (Application No. PCT/JP2005/018216) dated Dec. 27, 2005 (3 pages).

* cited by examiner

DISPLAY DEVICE AND ELECTRONIC DEVICE USING THE SAME

TECHNICAL FIELD

The present invention relates to a display device of a digital gray scale method and an electronic device using the same. In particular, the invention relates to a display device of a time gray scale method using a self-luminous material such as an organic electroluminescence (EL) and to an electronic device using the same.

BACKGROUND ART

In recent years, an active matrix semiconductor display device is attracting attentions in the market as a flat panel display (FPD). In particular, a self-luminous type active matrix display device using a self-luminous material such as an organic EL is attracting attentions and actively researched and developed as a flat panel display substituting a liquid crystal display (LCD).

An active matrix display device is known to be operated by an analog gray scale method in which luminance of each pixel is continuously changed or a digital gray scale method in which luminance of each pixel is pervasively changed. The analog gray scale method is realized by continuously changing a voltage applied to a light emitting element such as an EL element provided in each pixel to continuously change the luminance of the light emitting element. The digital gray scale method includes an area gray scale method in which a plurality of light emitting elements (or sub-pixels) having different areas are provided in each pixel and the combination of the light emitting elements to emit light is changed, thereby the luminance of each pixel is changed, and a time gray scale method in which one light emitting element is provided in each pixel and the light emission time of the light emitting element in one frame period (a period to display one image) is pervasively changed to change the luminance of each pixel. Further, it is widely known that a color display is performed by using a filter of red (R), green (G), or blue (B) for each pixel.

In the area gray scale method, a plurality of sub-pixels are provided in each pixel. For example, in the case where k sub-pixels $E_1, E_2, \ldots$, and $E_k$ are provided in each pixel (the number of bits is k) and the area of the smallest sub-pixel is $E_0$, the luminance of each pixel can be changed in $2^k$ gray scale levels with the luminance corresponding to $E_0$ as a minimum unit by designing so as to satisfy $E_1=1\times E_0$, $E_2=2\times E_0, \ldots$, and $E_k=2^{k-1}\times E_0$.

In the time gray scale method, one frame period is divided into a plurality of (for example, k) sub-frame periods $S_1, S_2, \ldots$, and $S_k$. When setting the shortest light emission period as $T_0$ and other light emission periods as $T_1=1\times T_0$, $T_2=2\times T_0, \ldots$, and $T_k=2^{k-1}\times T_0$ (the sum of the periods $T_1$ to $T_n$ is shorter than one frame period), the luminance of each pixel can be changed in $2^k$ gray scale levels with the luminance corresponding to $T_0$ as a minimum unit by changing the combination (i.e., selecting light emission/non-light emission of each pixel in each light emission period).

Such a display device of the time gray scale method requires a control circuit (panel controller) for converting inputted video data (or digital video signals) into a format of the time gray scale method and supplying the converted video data to a display panel at an appropriate timing (see Patent Document 1). FIG. 1 shows an example of the display device of the time gray scale method provided with such a panel controller.

A display device 1 in FIG. 1 includes a display panel 2 and a panel controller 3 to which a video data is inputted. The panel controller 3 includes a format converter portion 4 which converts the inputted video data into a format of the time gray scale method, a first video memory 5 and a second video memory 6, which store the converted video data which is converted in the format converter portion 4, and a display control portion 7 which reads the video data stored in the first video memory 5 and the second video memory 6 and transmits it to the display panel 2. The format converter portion 4 is connected to the first video memory 5 and the second video memory 6 through tri-state buffers 8 and 9 and the display control portion 7 is connected to the first video memory 5 and the second video memory 6 through a selector 10. The format converter portion 4 and the display control portion 7 are connected to each other so that they can operate in synchronization.

In the panel controller 3, the video data converted in the format converter portion 4 is written to the first video memory 5 in a certain frame period while video data converted in format which is stored in the second video memory 6 is read out to the display control portion 7 and transmitted to the display panel 2. In the next frame period, video data is written to the second video memory 6 and video data is read out from the first video memory 5 and transmitted to the display panel 2. The aforementioned operations are repeated alternately. That is, the first video memory 5 and the second video memory 6 are switched in turn to be used per frame. An SRAM can be preferably used as the first video memory 5 and the second video memory 6.

In recent years, however, the amount of video data tends to increase according to the increasing size of the display panel, and there is a case where video data of one frame is not stored in one SRAM. In view of this, a plurality of SRAMs are required to be provided for each of the first video memory 5 and the second video memory 6, which is not preferable for downsizing and cost reduction of a product.

On the other hand, a light emitting element such as an EL element is deteriorated by long time of light emission. Therefore, when a display device using an EL element is used for a long time, luminance characteristics of EL elements vary according to the deterioration of each EL element. That is, the deteriorated EL element and an EL element which is not deteriorated vary in luminance even when the same voltage is applied thereto.

In order to prevent such luminance variations, there is a deterioration compensation circuit which corrects the video data signal for driving the pixel of which EL element is deteriorated so as to compensate for the deterioration of the EL element by detecting the light emission time of the EL element in each pixel by regularly sampling a video data signal, and comparing the accumulation of the detected value and data on change with time of luminance characteristics of the EL element which is stored in advance (see Patent Document 2).

FIG. 2 is a block diagram showing an example of such a deterioration compensation circuit. A deterioration compensation circuit 20 in FIG. 2 includes a counter portion 21, a memory circuit portion 22, and a signal correction portion 23. The counter portion 21 includes a counter 12, the memory circuit portion 22 includes a volatile memory 13 and a non-volatile memory 14, and the signal correction portion 23 includes a correction circuit 15 and a correction data storing portion 16. In this deterioration compensation circuit 20, video data for driving a pixel of which EL element is deteriorated in a first video signal 11A as video data before correction is corrected in the signal correction potion 23 and supplied as a second video signal 11B as video data after correction to a display device 17.

In specific, the first video signal 11A is regularly (for example, per second) sampled in this deterioration compensation circuit 20 and the counter 12 counts the light emission and non-light emission of each pixel by the sampled signal. The counted number of light emission of each pixel, that is the accumulated light emission time (hereinafter referred to as accumulated time data) is sequentially stored in the memory circuit portion 22. The number of light emission is accumulated, therefore, the memory circuit portion is preferably formed using a nonvolatile memory. However, the number of writing to the nonvolatile memory is generally limited, therefore, data is written to the volatile memory 13 in operation of the display device 17 while the data is written to the nonvolatile memory 14 at a certain interval (for example, per hour, at shutdown of a power source, or the like). At shutdown of the power source, the data in the volatile memory 13 is lost, however, the accumulated time data is read out from the nonvolatile memory 14 to the volatile memory 13 when the power source is turned on later again, and thus the counting of the accumulated light emission time of an EL element is continued.

In the correction data storing portion 16 of the signal correction portion 23, data on change with time of luminance characteristics of the EL element is stored in advance as a map for correcting video signals. The correction circuit 15 compares the map for correcting video signals and the accumulated light emission time of each pixel which is read out from the volatile memory 13, and increases or decreases a digital video signal (pixel data) of each pixel according to the degree of deterioration of each pixel figured out from the accumulated light emission time, thereby the inputted first video signal 11A is corrected.

When the amount of video data is increased in such a deterioration compensation circuit 20, the amount of data to be transferred by the counter 12, the volatile memory 13, the nonvolatile memory 14, the correction circuit 15 and the like is increased, thereby these components are more frequently accessed. Accordingly, a component (especially a memory) capable of fast speed operation is required, which leads to increase the cost.

[Patent Document 1]

Japanese Patent Laid-Open No. 2004-163919

[Patent Document 2]

Japanese Patent Laid-Open No. 2002-175041

DISCLOSURE OF INVENTION

The invention is made in view of solving the aforementioned problems of a conventional technique. It is one of the objects of the invention to provide a display device of a digital gray scale method which has a panel controller for converting the format of the video data, and has a compact memory with low access speed, low cost and low power consumption and can prevent the increase in capacitance of a video memory used in the panel controller even when the amount of the inputted video data is increased due to the increase in size of the display panel and the like.

It is another object of the invention to provide a display device which includes a deterioration compensation circuit for compensating for deterioration of a light emitting element, and has a compact memory with low access speed, low cost and low power consumption to be used as a memory in the deterioration compensation circuit even when the amount of inputted video data is increased due to the increase in size of the display panel and the like.

In view of the aforementioned, according to the invention, a display device includes a display panel including a plurality of pixels, and a panel controller for converting the format of inputted video data into data to be displayed by a predetermined digital gray scale and supplying the data to the display panel. The panel controller includes a first video memory, a second video memory, a format converter portion for converting the format of inputted video data on a frame basis and writing the converted video data to the first video memory or the second video memory alternately, and a display control portion for reading out the converted video data stored in the first video memory or the second video memory and transmitting the data to the display panel. The plurality of pixels in the display panel are divided into first to n-th pixel regions ($n \geqq 2$). In each frame period, a format converter portion converts the format of video data corresponding to one of the first to n-th pixel regions and writes the data to one of the first and second video memories. The display control portion reads out the converted video data corresponding to the one of the first to n-th pixel regions which is written to the other of the first and second video memories in the preceding frame period and transmits the data to the display panel.

It is preferable that a pixel region in which video data is converted in format in the format converter portion in each frame period be sequentially selected in the order of the first, second, . . . , and n-th pixel regions, and after the n-th pixel region, the first pixel region be selected (that is, the first to n-th pixel regions are circularly selected). The aforementioned n may be, for example, 2.

In each frame period, video data of each pixel, which is in the pixel region reading out no video data from the first or second video memory, can be fixed at a predetermined value by the display control portion. Alternatively, the display control portion can set the video data at a predetermined value for each pixel in the pixel region in which video data is not read out from the first or second video memory based on the result of statistical process of video data of a pixel in the pixel region in which video data is read out from the first or second video memory provided in the periphery of the pixel.

According to another mode of the invention, a display device includes a display panel including a plurality of pixels, a deterioration compensation circuit which corrects inputted video data to compensate for the deterioration of a light emitting element in each pixel, and a panel controller for converting the format of video data inputted from the deterioration compensation circuit into data to be displayed by a predetermined digital gray scale and supplying the data to the display panel. The panel controller includes a first video memory and a second video memory, a format converter portion for converting the format of video data from the deterioration compensation circuit on a frame basis and writing the converted video data to the first or second video memory alternately, and a display control portion for reading out the converted video data stored in the first or second video memory and transmitting the data to the display panel. The plurality of pixels in the display panel are divided into the first to n-th pixel regions ($n \geqq 2$). The deterioration compensation circuit corrects video data corresponding to one of the first to n-th pixel regions among video data for one frame and generates correction video data. The format converter portion of the panel controller converts the format of the correction video data generated by the deterioration compensation circuit and writes the converted data to the first or second video memory.

It is preferable that a pixel region in which video data is corrected by the deterioration compensation circuit in each frame period be sequentially selected in the order of the first, second, . . . , and n-th pixel regions, and after the n-th pixel region, the first pixel region be selected (that is, the first to n-th pixel regions are circularly selected). The aforementioned n may be, for example, 2.

The deterioration compensation circuit includes a counter portion for detecting accumulated light emission time of each pixel, a memory circuit portion for storing the accumulated light emission time, and a signal correction portion for correcting video data according to the accumulated light emission time stored in the memory circuit portion. The signal correction portion includes a correction data storing portion which stores correction data based on a change with time of luminance characteristics of a light emitting element, an arithmetic circuit which generates correction video data by applying a predetermined arithmetic operation to video data using the correction data stored in the correction data storing portion, and an address converter portion which reads out from the memory circuit portion accumulated light emission time of a pixel in a pixel region in which video data is corrected in each frame period. The correction data storing portion outputs correction data according to an address to the arithmetic circuit.

It is preferable that the deterioration compensation circuit output to the panel controller correction video data corresponding to one of the first to n-th pixel regions in each frame period. In that case, the signal correction portion may further includes a latch connected to an input of the arithmetic circuit, so that the video data is inputted to the arithmetic circuit through the latch. The latch may sample the video data corresponding to one of the first to n-th pixel regions to be corrected and may input to the arithmetic circuit in each frame period. Further, the counter portion may include an adder and a latch connected to an input terminal of the adder. In each frame period, correction video data corresponding to one of the first to n-th pixel regions may be transmitted from the arithmetic circuit to a latch of the counter portion. The counter portion regularly samples the correction video data to be transmitted to the adder. The adder reads out from the memory circuit portion accumulated light emission time of a pixel in a pixel region in which correction video data is transmitted to the adder and adds the correction video data to the read accumulated light emission time, thereby the accumulated light emission time is updated.

According to another mode of the invention, the deterioration correction circuit may output to the panel controller correction video data corresponding to one of the first to n-th pixel regions and non-correction video data corresponding to the other pixel regions. In that case, the signal correction portion further includes a selector provided between the arithmetic circuit and the correction data storing portion. The selector includes two input terminals and one output terminal. The output terminal is connected to an input terminal of the correction circuit. One of the two input terminals is connected to the output terminal of the correction data storing portion. The other of the two input terminals is inputted with a predetermined value. The selector operates so that the correction data stored in the correction data storing portion is inputted to the arithmetic circuit when video data corresponding to one of the first to n-th pixel regions is inputted to the arithmetic circuit, and so that a predetermined value is inputted to the arithmetic circuit when video data on the other pixel regions is inputted to the arithmetic circuit. The predetermined value may be a value which does not change video data even when the arithmetic circuit applies an arithmetic operation to the video data.

It is preferable that the counter portion includes an adder and a latch connected to an input terminal of the adder. Correction video data corresponding to one of the first to n-th pixel regions and non-correction video data corresponding to the other pixel regions are transmitted from the arithmetic circuit to the latch of the counter portion, the latch in the counter portion regularly samples correction video data corresponding to one of the first to n-th pixel regions and transmits to the adder. The adder reads out from the memory circuit portion accumulated light emission time of a pixel in a pixel region in which correction video data is transmitted to the adder, and adds the correction video data to the read accumulated light emission time, thereby the accumulated light emission time is updated.

It is preferable that the display device be a display device of the time gray scale method.

According to another mode of the invention, an electronic device including the aforementioned display device is provided.

According to a display device of the invention, in each frame period, pixels of a display panel are divided into the first to n-th pixel regions and only video data corresponding to one of the first to n-th pixel regions is converted in format in the format converter portion and transmitted to the first or second video memory, thereby the amount of video data stored in the first and second video memories can be suppressed to about 1/n. Accordingly, a compact and inexpensive video memory with small capacitance can be used even when the amount of inputted video data is large.

In each frame period, a pixel region in which video data is converted in format in the format converter portion is sequentially selected in the order of the first, second, . . . , and n-th pixel regions, and after the n-th pixel region, the first pixel region is selected, thereby these pixel regions can be used evenly. Provided that n is 2, video data corresponding to the first pixel region and video data corresponding to the second pixel region are alternately converted in format on a frame basis and written to the first or second video memory. Thus, the amount of video data stored in the first and second video memories can be suppressed to about half.

In each frame period, the display control portion can fix video data at a predetermined value for each pixel in a pixel region in which video data is not read out from the first or second video memory. Accordingly, a load imposed on the display control portion can be reduced, however, a flicker and the like may occur in the image. In each frame period, the display control portion sets video data for each pixel in a pixel region in which video data is not read out from the first or the second memory based on the result of statistical process of video data of a pixel in a pixel region in which video data is read out from the first or second video memory provided in the periphery of the pixel, thereby the flicker in the image, which may occur in the case where the video data is fixed at a predetermined value, can be reduced.

Further, according to a self-luminous display device of another embodiment of the invention, a deterioration compensation circuit, which corrects video data inputted to compensate for the deterioration of a light emitting element, corrects only video data corresponding to one of the first to n-th pixel regions among video data for one frame and generates correction video data. The format converter portion of the panel controller converts the format of only the correction video data generated by the deterioration compensation circuit and writes the data to the first or second video memory. Therefore, the amount of video data written to the video memory of the panel controller can be reduced to 1/n, and thus a small capacitance, compact, and low cost memory can be used as these video memories.

In each frame period, a pixel region in which video data is corrected in the format converter portion is sequentially selected in the order of the first, second, . . . , and n-th pixel regions, and after the n-th pixel region, the first pixel region is selected, thereby these pixel regions can be used evenly. Provided that n is 2, video data corresponding to the first pixel region and video data corresponding to the second pixel region are alternately corrected. Accordingly, in the panel controller, video data corresponding to the first pixel region and video data corresponding to the second pixel region are alternately converted in format on a frame basis and written to the first or second video memory, thus the amount of video data stored in the first and second video memories can be suppressed to about half.

The deterioration compensation circuit preferably has a counter portion for detecting accumulated light emission time of each pixel, a memory circuit portion for storing the accumulated light emission time, and a signal correction portion for correcting video data according to the accumulated light emission time stored in the memory circuit portion. The signal correction portion includes a correction data storing portion which stores correction data based on a change with time of luminance characteristics of a light emitting element, an arithmetic circuit which applies a predetermined arithmetic operation to video data by using the correction data stored in the correction data storing portion and generates correction video data, and an address converter portion which reads out from the memory circuit portion accumulated light emission time of a pixel in a pixel region in which video data is corrected and converts the data into an address for accessing the correction data storing portion. The correction data storing portion may output correction data to the arithmetic circuit according to the address. Such a deterioration compensation circuit corrects video data of 1/n of the amount of the inputted video data, therefore, the number of reading out the accumulated light emission time of a corresponding pixel from the memory circuit portion to the address converter portion is reduced. Therefore, an inexpensive memory with low power consumption and low access speed can be used as the memory circuit portion.

In each frame period, in the case where the deterioration compensation circuit outputs only the generated correction video data corresponding to one of the first to n-th pixel regions to the panel controller, the panel controller converts the format of only 1/n of the video data corrected by the deterioration compensation circuit and writes the data to the video memory even when the panel controller does not have a function to reduce the amount of video data to be written to the video memory. Therefore, a small capacitance, compact, and low cost memory can be used as the video memory of the panel controller.

In that case, it is preferable that the signal correction portion further include a latch connected to an input of the arithmetic circuit and video data be inputted to the arithmetic circuit through the latch. By controlling this latch, only video data corresponding to one of the first to n-th pixel regions, which is corrected in each frame period is sampled and inputted to the arithmetic circuit, thereby only the video data corresponding to the one of the first to n-th pixel regions can be corrected in the arithmetic circuit and outputted.

In each frame period, only correction video data corresponding to one of the first to n-th pixel regions is transmitted from the arithmetic circuit to the adder of the counter portion while accumulated light emission time of a pixel in the selected pixel region is read our from the memory circuit portion and transmitted to the adder, and then the accumulated light emission time and the correction video data are added so that the accumulated light emission time is updated, thereby the number of reading out the accumulated light emission time from the memory circuit portion to the adder can be reduced and an inexpensive memory with low power consumption and low access speed can be used as the memory circuit portion.

As another method, in each frame period, the deterioration compensation circuit may output to the panel controller correction video data corresponding to one of the first to n-th pixel regions and non-correction video data corresponding to the other pixel regions. Such a deterioration compensation circuit further includes a selector provided between the arithmetic circuit and the correction data storing portion. The selector includes two input terminals and one output terminal. The output terminal is connected to an input terminal of the correction circuit, and one of the two input terminals is connected to the output terminal of the correction data storing portion. A predetermined value is inputted to the other of the two input terminals. The selector operates so that the correction data stored in the correction data storing portion is inputted to the arithmetic circuit when video data corresponding to one of the first to n-th pixel regions is inputted to the arithmetic circuit, and so that a predetermined value is inputted to the arithmetic circuit when video data corresponding to the other pixel regions is inputted to the arithmetic circuit. The predetermined value may be a value which does not change video data even when the arithmetic circuit applies an arithmetic operation to the video data. With such a structure, video data corrected in the arithmetic circuit is also 1/n of the inputted video data. Further, the number of pixels of which accumulated light emission time is actually updated at a regular update of the accumulated light emission time becomes 1/n of the total number of pixels. Accordingly, the number of reading of the accumulated light emission time of a pixel stored in the memory circuit portion is reduced to 1/n for generating an address for reading out correction data used for video data correction from the correction data storing portion is reduced to 1/n, therefore, an inexpensive memory with low power consumption and low access speed can be used as the memory circuit portion.

In each frame period, in the case where the correction video data corresponding to one of the first to n-th pixel regions and the non-correction video data corresponding to the other pixel regions are transmitted from the arithmetic circuit to the counter portion, the counter portion includes an adder and a latch connected to an input terminal of the adder. The latch of the counter portion regularly samples only the correction video data corresponding to the one of the first to n-th pixel regions and transmits the data to the adder. The adder reads out from the memory circuit portion the accumulated light emission time of a pixel in the pixel region in which the correction video data is transmitted to the adder, so that the accumulated light emission time is updated by adding the correction video data to the accumulated light emission time. Accordingly, the number of reading out the accumulated light emission time from the memory circuit portion to the adder can be reduced, thereby an inexpensive memory with low power consumption and low access speed can be used as the memory circuit portion.

The aforementioned display device is preferably a display device of a time gray scale method. By using the aforementioned display device to form an electronic device, cost reduction and downsizing of the electronic device can be easily realized.

BEST MODE FOR CARRYING OUT THE INVENTION

Hereinafter described with reference to the drawings is an embodiment mode of the invention.

Figure 3:
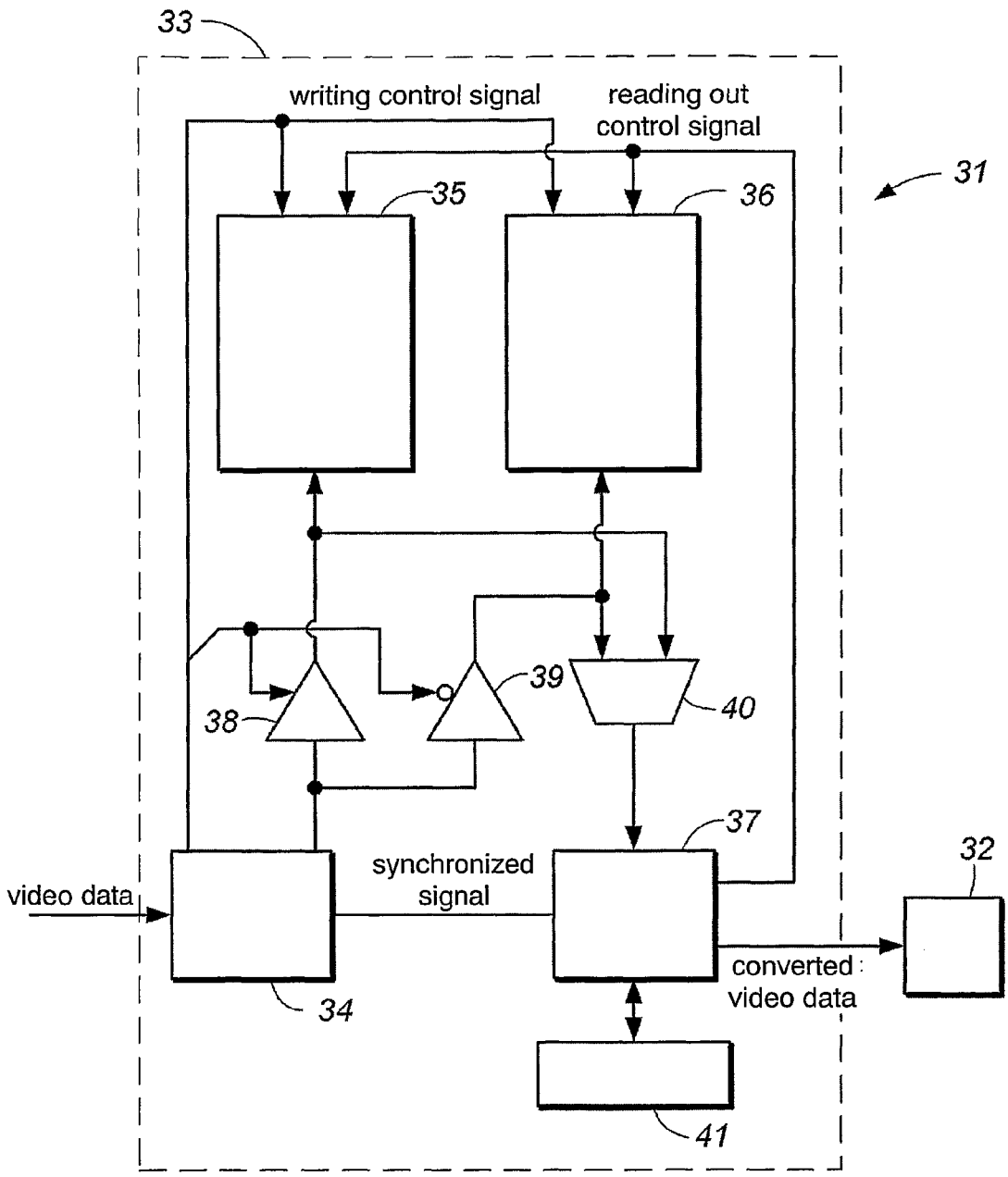
FIG. 3 is a block diagram showing a preferred embodiment of a display device of the invention.

FIG. 3 is a block diagram showing a preferred embodiment of a display device according to the invention. A display device 31 includes an active matrix display panel 32 using a self-luminous material such as an organic EL material and a panel controller 33 which converts the format of inputted video data and supplies the converted video data to the display panel 32 at an appropriate timing.

Figure 1:
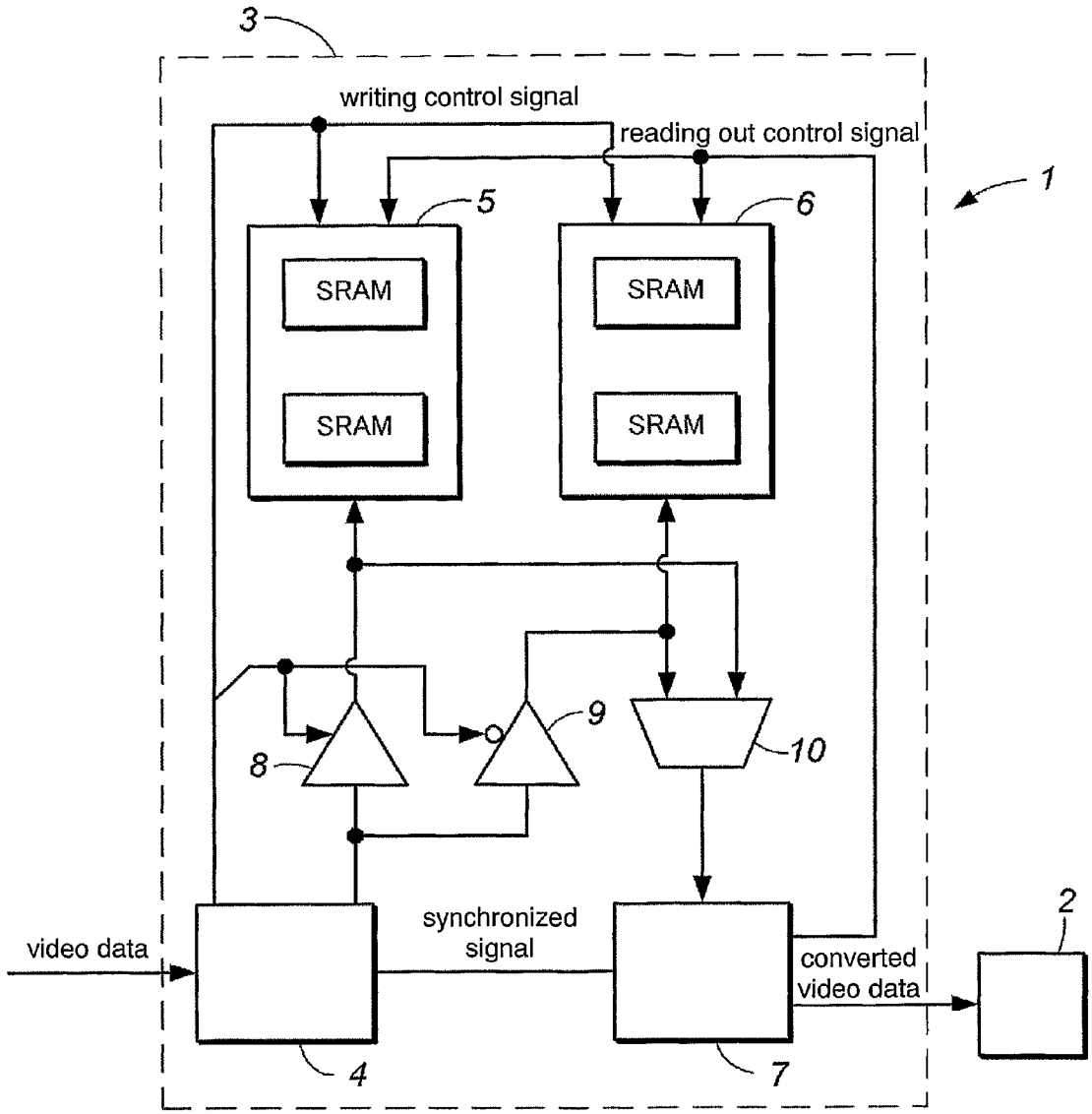
FIG. 1 is a block diagram showing an example of a display device of the time gray scale method, which is provided with a conventional panel controller.

The panel controller 33 includes a format converter portion 34, a first video memory 35, a second video memory 36, a display control portion 37, a first tri-state buffer 38, a second tri-state buffer 39, and a selector 40 similarly to the conventional example shown in FIG. 1.

In this embodiment shown in FIG. 3, pixels of the display panel 32 are divided into, for example, first and second pixel regions. The format converter portion 34 converts the format of only video data corresponding to the first pixel region and writes the data to the first video memory 35 in a certain frame period, and converts the format of only video data corresponding to the second pixel region and writes the data to the second video memory 36 in the next period. The aforementioned operations are alternately repeated. While the video data converted in format is written to one of the first video memory 35 and the second video memory 36, the display control portion 37 reads out the video data converted in format stored in the other of the first video memory 35 and the second video memory 36 and transmits the data to the display panel 32 to display an image.

Figure 4:
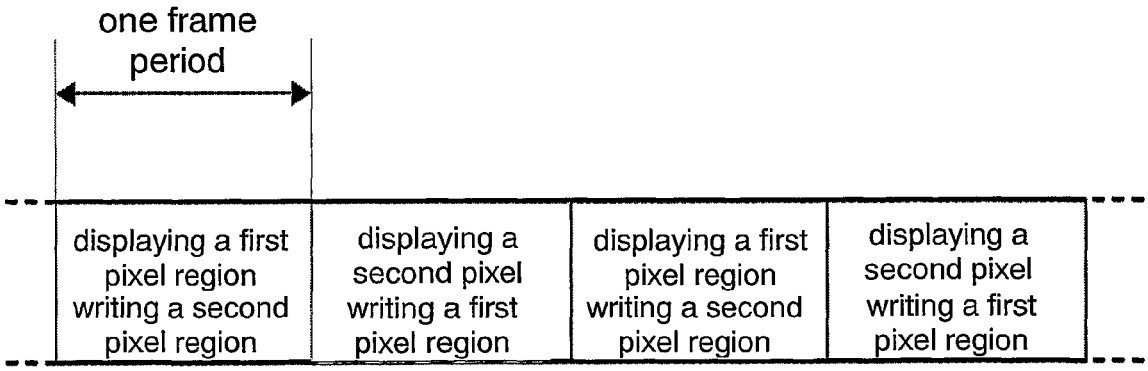
FIG. 4 is a time chart showing an operation of the panel controller of FIG. 3.

In this manner, as shown in a time chart of FIG. 4, in a certain frame period writing of video data corresponding to the first pixel region and reading of video data corresponding to the second pixel region to display an image are performed. In the next frame period, writing of video data corresponding to the second pixel region and reading of video data corresponding to the first pixel region to display an image are performed. In this manner, reading and writing of video data are alternately repeated in each pixel.

Figure 5A:
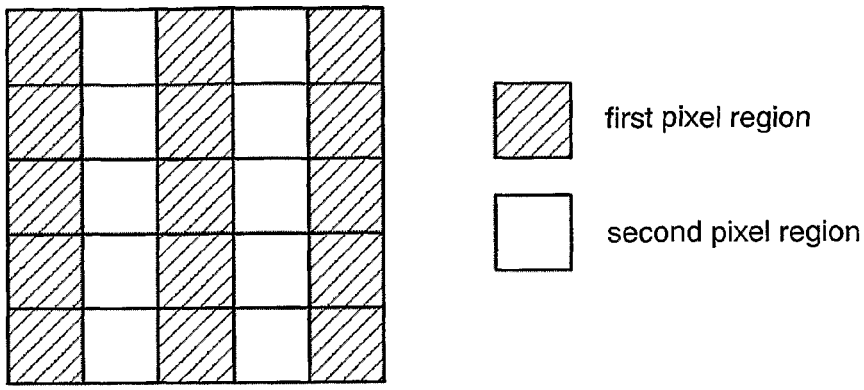
FIGS. 5A to 5C are schematic diagrams showing examples of a pixel region.
Figure 5B:
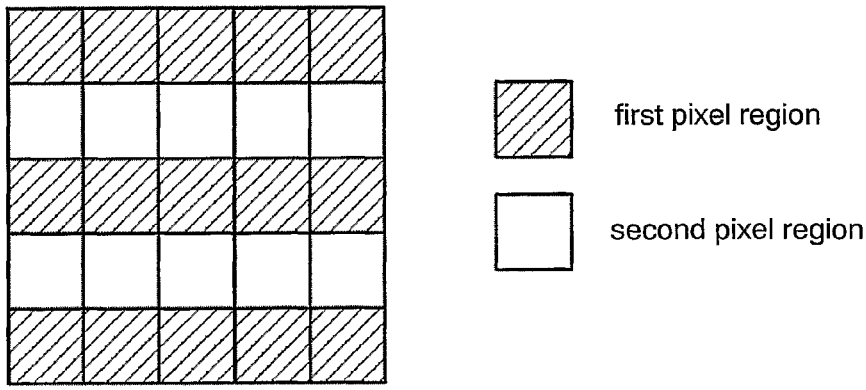
Figure 5C:
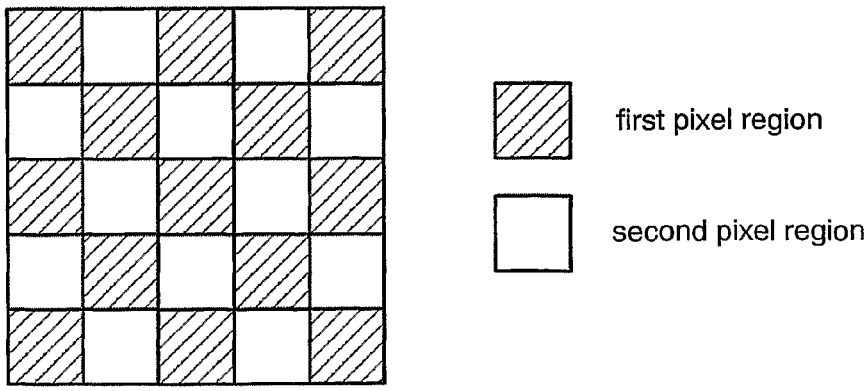

As examples of the first and second pixel regions, each of the first and second pixel regions may have pixels arranged in alternate columns or rows (stripe pattern) as shown in FIGS. 5A and 5B, or the first and second pixel regions may have pixels arranged so that each pixel is arranged adjacent to a pixel of the other pixel region in horizontal and perpendicular directions like a checkerboard as shown in FIG. 5C. It is preferable that a pixel of the other pixel region is arranged as close as possible to each pixel of one pixel region. It is to be noted in FIGS. 5A to 5C that pixels of 5 rows×5 columns are shown, however, it is needless to say that the number of rows and columns of the display panel 32 is not limited to this.

In each frame period, video data pixel data) of each pixel, which is in a pixel region (non-reading pixel region) in which video data is not read out from the first video memory 35 or the second video memory 36, can be fixed at a certain value by the display control portion 37, however, a flicker and the like may occur in the image. In order to reduce the flicker, video data of a pixel in the non-reading pixel region can be guessed or set at an approximate value based on video data of a pixel in the pixel region (reading pixel region) to which the video data is transmitted, adjacent to or near the periphery of the non-reading pixel region. For example, bits of video data (for example, 8 bits) for one pixel are divided into a first bit group UB (for example more significant 4 bits) which affects more to luminance of the pixel and a second bit group LB (for example less significant 4 bits) which affects less thereto. In a subframe period corresponding to the second bit group LB, a bit value of each pixel in the non-reading pixel region is fixed at a certain value (for example, "1" (light emission) or "0" (non-light emission)). In a subframe period corresponding to the first bit group UB, statistics are taken bit values of pixels in the reading pixel region which are arranged adjacent to or near the periphery of each pixel in the non-reading pixel region, thereby a bit value of the pixels in the non-reading pixel region can be set. In a special case, the first bit group UB has only the most significant bit (MUB) and a majority decision can be made as a statistic process (that is, in the case where many pixels in the reading pixel region in the periphery of a target pixel have the most significant bit of 1, the most significant bit of the target pixel is 1 while the most significant bit of the target pixel is 0 when many pixels have the most significant bit of 0).

In the case of taking statistics of video data of pixels in the reading pixel region in the display control portion 37 as described above, a small capacitance memory 41 for temporarily holding video data transmitted from the first video memory 35 and the second video memory 36 may be provided as required. In particular, in the case where the statistics of only the most significant bit of each pixel are taken as described above, the capacitance of the memory 41 can be quite small.

As described above, the pixels in the display panel 32 are divided into the first and second pixel regions and video data corresponding to the first pixel region and video data corresponding to the second pixel region are alternately converted in format in the format converter portion 34 or transmitted to the first video memory 35 and the second video memory 36, thereby the amount of video data stored in the first video memory 35 and the second video memory 36 can be suppressed to about half. Accordingly, a compact and inexpensive video memory with small capacitance can be used even when the amount of inputted video data is large.

It is to be noted that the pixels in the display panel 32 are divided into the first pixel region and the second pixel region in the embodiment shown in FIG. 3, however, the pixels may be divided into three, four or more regions. Further, in this embodiment, two video memories is used, however, the present invention is not limited to this. The plurality of video memories may be used. In general, in the case of dividing the pixels into n ($n \geqq 2$) pixel regions of first to n-th pixel regions, the format converter portion 34 converts the format of only video data corresponding to the selected region which is one of the first to n-th pixel regions and writes the data to one of the first video memory 35 and the second video memory 36 in each frame period. In each frame period, a pixel region in which video data is converted in format is circularly selected from the first to n-th pixel regions (that is, the pixel regions are selected in the order of the first, second, . . . , and n-th pixel regions and after the n-th pixel region, the first pixel region is selected). Accordingly, the amount of video data stored in the video memory is suppressed to about 1/n.

Figure 6:
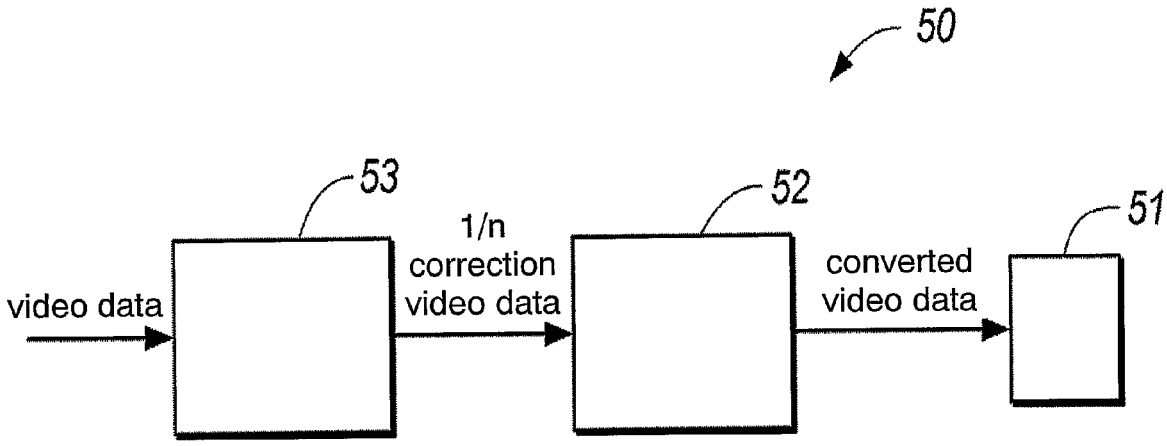
FIG. 6 is a block diagram showing another embodiment of a display device of the invention.

FIG. 6 is a block diagram showing another embodiment of a display device of the invention. A display device 50 includes a display panel 51 using an EL element as a light emitting element, a panel controller 52, and a deterioration compensation circuit 53 to which video data is inputted. The deterioration compensation circuit 53 corrects the video data to compensate for the deterioration of the EL element in each pixel based on accumulated light emission time. The panel controller 52 converts the format of correction video data inputted from the deterioration correction circuit 53 into video data for the time gray scale and supplies the converted data to the display panel 51, and may have a similar structure to the panel controller 33 shown in FIG. 3.

In this embodiment shown in FIG. 6, pixels in the display panel 51 are divided into n ($n \geqq 2$) pixel regions similarly to the embodiment shown in FIG. 3. The deterioration compensation circuit 53 corrects video data corresponding to the first pixel region and supplies the data to the panel controller 52 in a certain frame period, and corrects video data corresponding to the second pixel region and supplies the data to the panel controller 52 in the next frame period. In this manner, a similar process is sequentially repeated to the video data corresponding to each pixel region. After the correction process of video data corresponding to the n-th pixel region, correction process of video data corresponding to the first pixel region starts. Therefore, as shown in FIG. 6, the amount of video data after correction to be transmitted to the panel controller 52 becomes 1/n of the inputted video data in each frame period. Accordingly, even when the panel controller 52 (more specifically, a format converter portion thereof) does not have a function to decrease the amount of video data written to the video memory as that of the panel controller 33 in FIG. 3, only 1/n of video data corrected by the deterioration compensation circuit 53 is converted in format in the panel controller 52 and written to the video memory. Therefore, a compact and inexpensive video memory with small capacitance can be used as the video memory of the panel controller 52.

Figure 2:
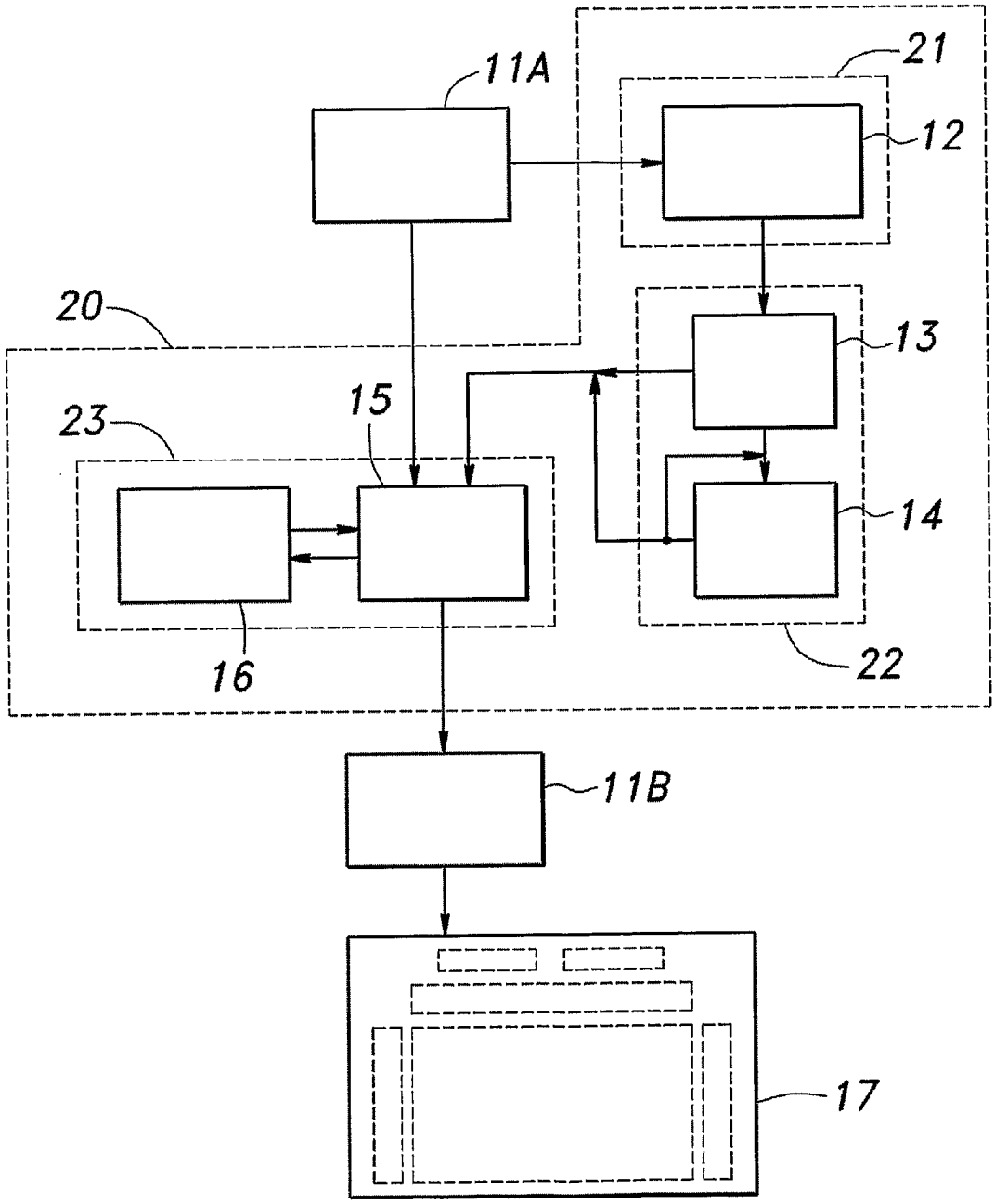
FIG. 2 is a block diagram showing an example of a conventional deterioration compensation circuit.
Figure 7:
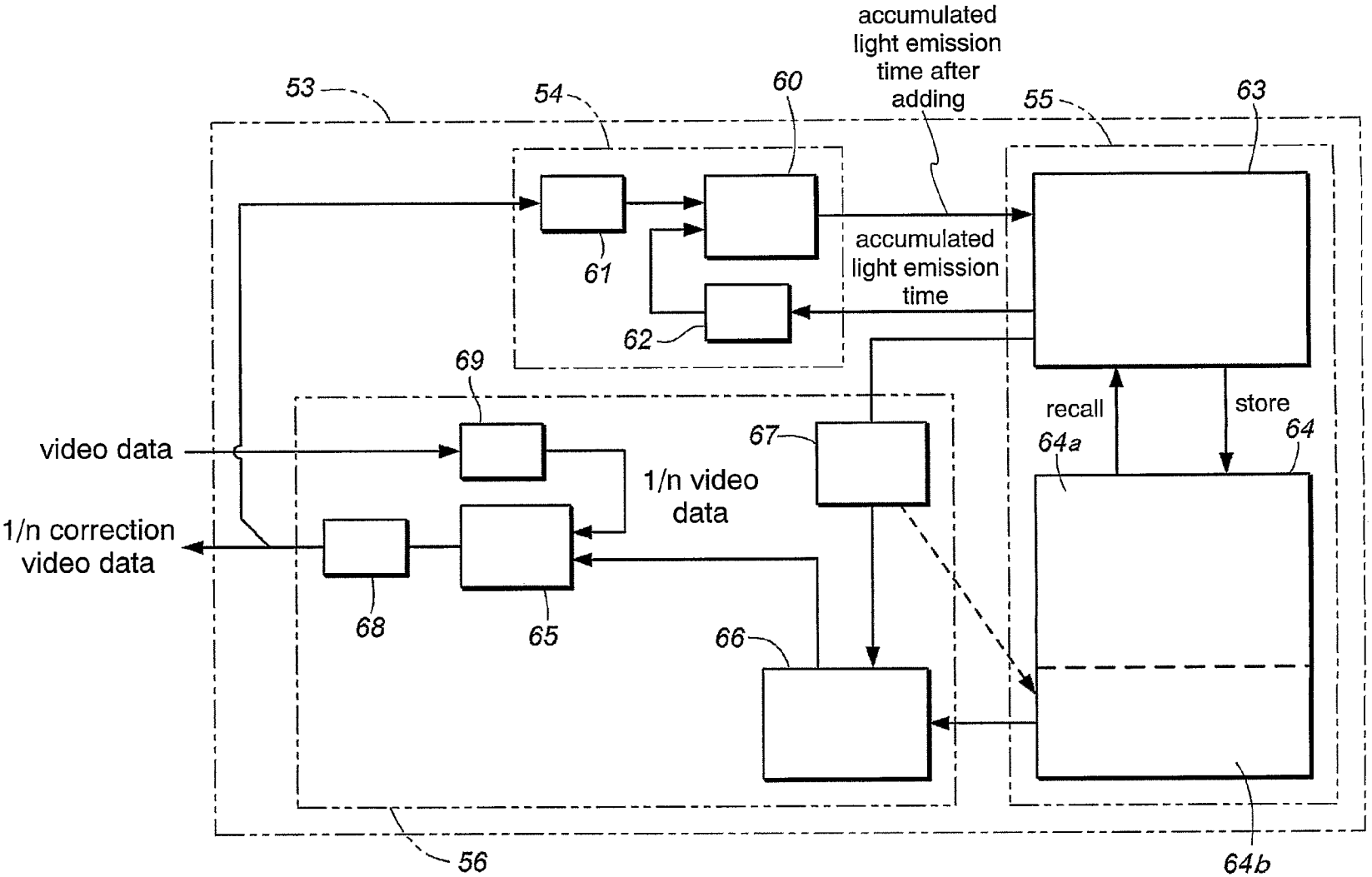
FIG. 7 is a block diagram showing details of the deterioration compensation circuit 53 of FIG. 6.

FIG. 7 is a block diagram showing the details of the deterioration compensation circuit 53 of FIG. 6. The deterioration compensation circuit 53 includes a counter portion 54, a memory circuit portion 55, and a signal correction portion 56 similarly to the deterioration compensation circuit 20 in FIG. 2. The counter portion 54 includes an adder 60 which operates as a counter and two latches 61 and 62. The memory circuit portion 55 includes a volatile memory 63 and a nonvolatile memory 64. The signal correction portion 56 includes a multiplier 65 which operates as an arithmetic circuit, a deterioration coefficient holding register 66, an address converter portion 67, and two latches 68 and 69.

The volatile memory 63 stores accumulated light emission time of each pixel. It is to be noted that video data of each pixel before format conversion generally shows luminance of the pixel, however, accumulated light emission time of each pixel can be obtained by adding video data before format conversion since luminance of a pixel in a certain frame is substantially equivalent to light emission time of the pixel in the frame.

The nonvolatile memory 64 includes an accumulated light emission time backup region 64*a*. Similarly to the conventional technique, data in the volatile memory 63 is written (stored) to the accumulated light emission time backup region 64*a* of the nonvolatile memory 64 at a certain interval (for example, per hour or at shutdown of a power source). When turning on the power source, accumulated light emission time data is read out (recalled) from the accumulated light emission time backup region 64*a* to the volatile memory 63.

The nonvolatile memory 64 includes a deterioration coefficient holding region 64*b* in which a deterioration coefficient is stored in advance as correction data generated based on a change with time of luminance characteristics of an EL element. For example, the data in the deterioration coefficient holding region 64*b* is read out to a deterioration coefficient holding register 66 in the signal correction portion 56 when the power source is turned on.

In this deterioration compensation circuit 53, video data is transmitted to the multiplier 65 through the latch 69 of the signal correction portion 56. At this time, by appropriately controlling the latch 69, only video data corresponding to the first pixel region is transmitted to the multiplier 65 in a certain frame period and only video data corresponding to the second pixel region is transmitted to the multiplier 65 in the next frame period. The aforementioned operations are sequentially performed for up to video data corresponding to the n-th pixel region and after that, video data corresponding to the first pixel region is selected. In this manner, a similar process can be repeated. That is, a pixel region in which video data is transmitted to the multiplier 65 in each frame period is circularly selected from the first to n-th pixel regions. Accordingly, in each frame period, about 1/n of inputted video data is transmitted to the multiplier 65. It is to be noted that when $n=2$ is satisfied, video data corresponding to the first and second pixel regions is alternately transmitted to the multiplier 65 and about half of the inputted video data is supplied to the multiplier 65 in each frame period.

The address converter portion 67 converts accumulated light emission time of each pixel into an address for accessing the deterioration coefficient holding register 66 in accordance with the 1/n video data transmitted to the multiplier 65, and the deterioration coefficient holding register 66 reads out a deterioration coefficient stored in the specified address and transmits it to the multiplier 65. In this case, the deterioration coefficient holding register 66 operates as a correction data storing portion. Alternatively, the address converter portion 67 converts accumulated light emission time of each pixel into an address for accessing the deterioration coefficient holding region 64*b* of the nonvolatile memory 64 based on the 1/n video data transmitted to the multiplier 65 and reads out a deterioration coefficient stored in the specified address in the deterioration coefficient holding region 64*b* and transmits it to the multiplier 65 through the deterioration coefficient holding register 66. In this case, the deterioration coefficient holding region 64*b* of the nonvolatile memory 64 operates as a correction data holding portion. In the latter case, data in the deterioration coefficient holding region 64*b* is not required to be read out to the deterioration coefficient holding register 66 when the power source is turned on.

The multiplier 65 generates correction video data by multiplying the inputted deterioration coefficient and video data. As described above, the video data inputted to the multiplier 65 is 1/n of the inputted video data, therefore, correction video data outputted from the multiplier 65 is also 1/n of the inputted video data. Further, only a deterioration coefficient corresponding to the 1/n video data inputted to the multiplier 65 is required to be transmitted from the deterioration coefficient holding register 66 to the multiplier 65, therefore, the number of accesses to the deterioration coefficient holding register 66 can be drastically reduced. Accordingly, it is also possible to reduce the number of accesses to the volatile memory 63 for reading accumulated light emission time of each pixel, which is required to generate an address for accessing the deterioration coefficient holding register 66.

The correction video data is regularly (for example, per second) sampled and inputted to the adder 60 through the latch 61 of the counter portion 54. The volatile memory 63 transmits accumulated light emission time of a pixel in the pixel region in which correction video data is transmitted to the adder 60, through the latch 62 to the adder 60. The adder 60 adds correction video data and accumulated light emission time of each pixel, thereby the accumulated light emission time is updated. Accordingly, the frequency to access the volatile memory 63 for reading out the accumulated light emission time to be transmitted to the adder 60 is reduced to 1/n. The updated accumulated light emission time is stored in the volatile memory 63.

As described above, the amount of the correction video data outputted from the deterioration compensation circuit 53 is reduced to 1/n of the inputted data, thereby the capacitance of a video memory in the panel controller 52 which receives correction video data from the deterioration compensation circuit 53 can be reduced. In the deterioration compensation circuit 53, video data corrected in the multiplier 65 is 1/n of inputted video data in each frame period. Accordingly, accumulated light emission time of 1/n of the total number of pixels is updated by regular updating (detecting) of the counter portion 54. Therefore, the number of reading out the accumulated light emission time of a pixel stored in the volatile memory 63 to the address converter portion 67 and the adder 60 is reduced to 1/n, thereby an inexpensive memory with low power consumption and low access speed can be used as the volatile memory 63.

Figure 8:
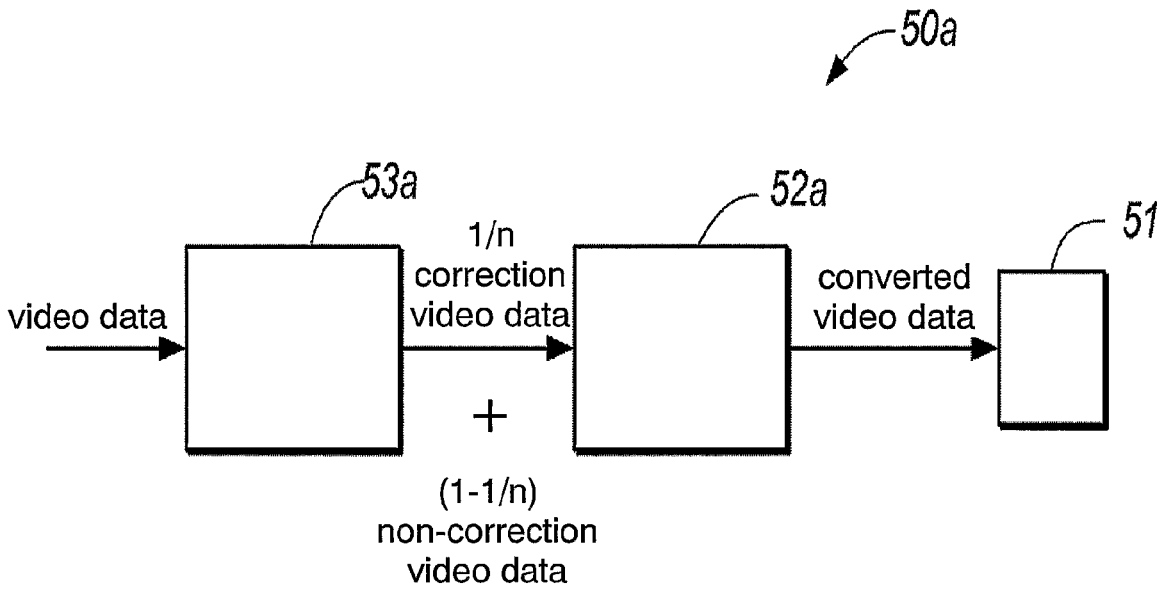
FIG. 8 is a block diagram showing another embodiment of a display device of the invention.

FIG. 8 is a block diagram showing another embodiment of a display device according to the invention. A display device 50*a* includes the display panel 51 shown in FIG. 6, a panel controller 52*a*, and a deterioration compensation circuit 53*a* to which video data is inputted. This embodiment of FIG. 8 is the same as the embodiment of FIG. 6 in that video data corrected by the deterioration compensation circuit 53*a* is 1/n of inputted data in each frame period, however, different in that (1−1/n) of non-correction video data is also transmitted to the panel controller 52*a*. Therefore, in the embodiment of FIG. 8, the amount of video data inputted to the panel controller 52*a* is the same as that of the video data inputted to the deterioration compensation circuit 53*a*. Accordingly, the panel controller 52*a* has a function to convert the format of only video data corresponding to the selected pixel region and to writes the data to a video memory for reducing the amount of video data to be written to the video memory therein, similarly to the panel controller 33 in FIG. 3.

Figure 9:
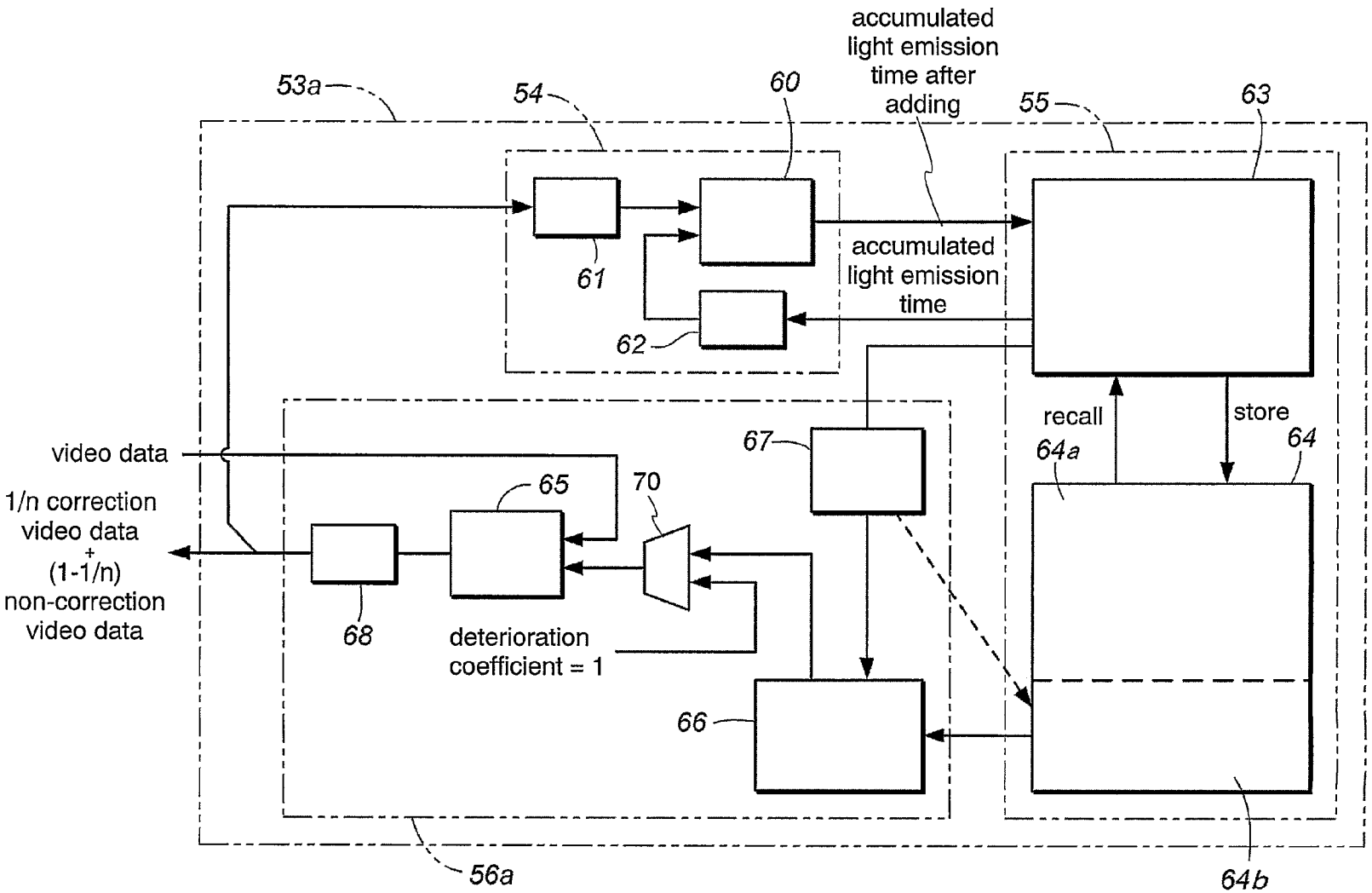
FIG. 9 is a block diagram showing details of the deterioration compensation circuit 53*a* of FIG. 8.

FIG. 9 is a block diagram showing details of the deterioration compensation circuit 53*a* shown in FIG. 8. In FIG. 9, similar portions to those in FIG. 7 are denoted by the same reference numerals and detailed descriptions thereof are omitted. This deterioration compensation circuit 53*a* is different than that shown in FIG. 7 in that video data is directly inputted to the multiplier 65 without through a latch and a deterioration coefficient from the deterioration coefficient holding register 66 and a fixed value "1" are selectively inputted to the multiplier 65 through a selector 70 in the signal correction portion 56. That is, one of the two input terminals of the selector 70 is connected to an output terminal of the deterioration coefficient holding register 66 while the other is always inputted with a fixed value "1" and an output terminal thereof is connected to one of two input terminals of the multiplier 65 (the other of two input terminals of the multiplier 65 is inputted with video data). In each frame period, the selector 70 transmits a deterioration coefficient from the deterioration coefficient holding register 66 to the multiplier 65 when video data of a pixel region to be corrected is inputted to the multiplier 65 so that correction is performed, while the selector 70 transmits a deterioration coefficient "1" is transmitted to the multiplier 65 when video data of a pixel region which is not corrected is inputted to the multiplier 65 so that correction of video data is not performed. Accordingly, video data outputted from the deterioration compensation circuit 53*a* includes 1/n correction video data and (1−1/n) non-correction video data.

Further, both 1/n correction video data and (1−1/n) non-correction video data are transmitted to the latch 61 of the counter portion 54. Therefore, the latch 61 samples video data so that only the 1/n correction video data is inputted to the adder 60.

In FIG. 9 as well, in each frame period, video data corrected by the multiplier 65 becomes 1/n of inputted video data. Further, 1/n of the total number of pixels is updated in accumulated light emission time by regular updating of accumulated light emission time. Therefore, the number of reading out the accumulated light emission time stored in the volatile memory 63 for video data correction and updating of accumulated light emission time to the address converter portion 67 and the adder 60 can be reduced to 1/n, thereby an inexpensive memory with low power consumption and low access speed can be used as the volatile memory 63.

Figure 10:
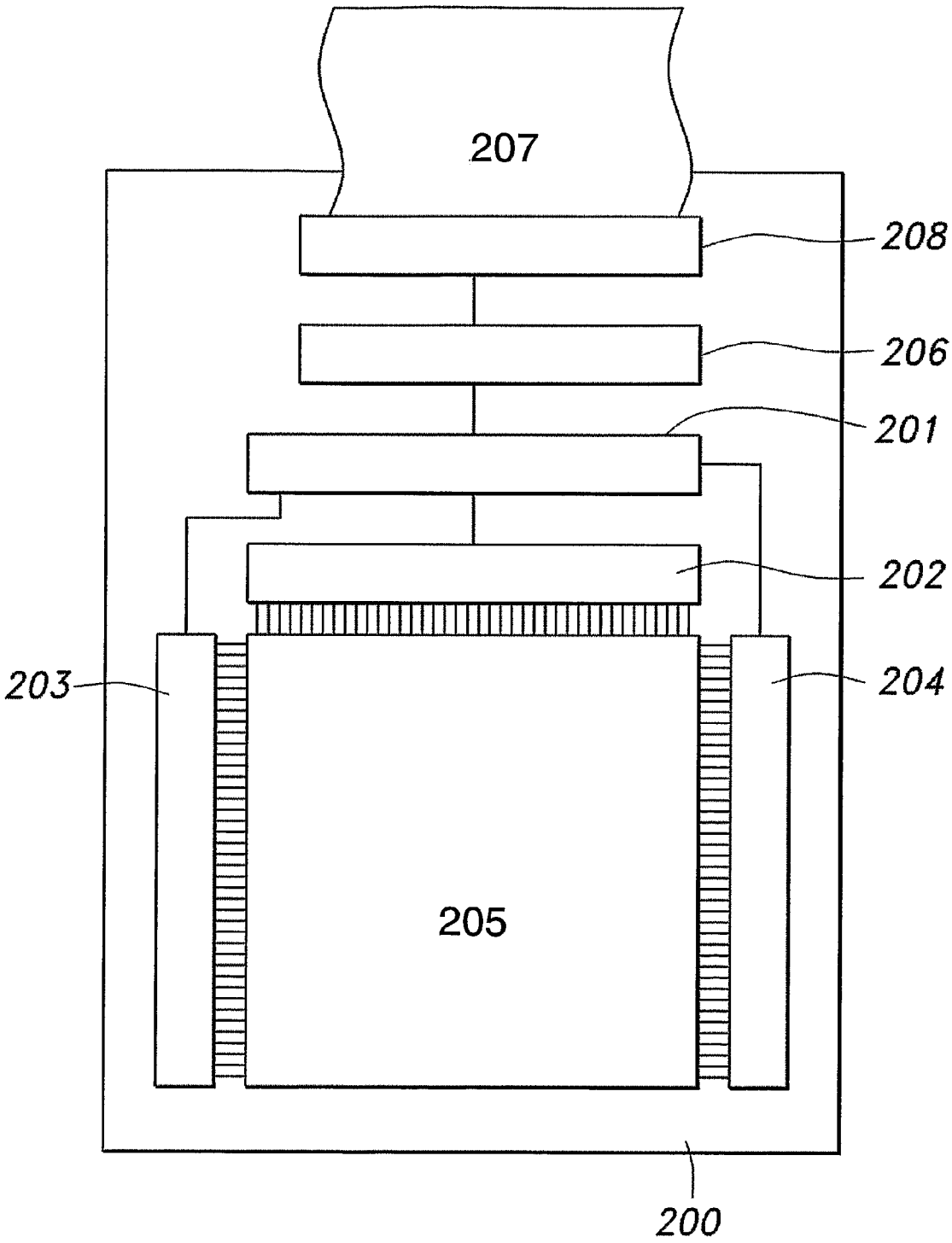
FIG. 10 is a diagram showing an example of a display device of the invention.

The aforementioned panel controller and/or the deterioration compensation circuit may be formed separately and provided externally of the display panel. Alternatively, as shown in FIG. 10, the panel controller and/or the deterioration compensation circuit may be integrated over the same substrate as the display panel. The display device shown in FIG. 10 includes a panel controller 201, a source signal line driver circuit 202, gate signal line driver circuits 203 and 204, a pixel matrix portion (or a display panel) 205, a deterioration compensation circuit 206, and a connecter 208, which are integrated over a substrate 200, and video data is inputted through a flexible printed circuit (FPC) 207 connected to the connector 208. The panel controller 33 shown in FIG. 3 can be used as the panel controller 201 and the deterioration compensation circuits 53 and 53*a* shown in FIGS. 7 and 9 respectively can be used as the deterioration compensation circuit 206. It is preferable to use a glass substrate as the substrate 200, however, other substrates such as a heat resistant plastic substrate can also be used. The source signal line driver circuit 202 and the gate signal line driver circuits 203 and 204 may be formed of known circuits, and only one gate signal line driver circuit may be provided depending on the configuration of the circuit.

In this manner, by integrating the panel controller 201 and the deterioration compensation circuit 206 over the same substrate as the display panel 205, cost reduction, space saving, and fast speed drive of a display device can be realized by drastic reduction in the number of components.

Electronic devices to which the invention can be applied include a desktop, floor standing, or wall hanging display, a camera such as a video camera and a digital camera, a goggle type display, a navigation system, an audio reproducing device (car audio set, audio component set or the like), a computer, a game machine, a portable information terminal (mobile computer, portable phone, portable game machine, electronic book or the like), an image reproducing device provided with a recording medium (specifically, a device which reproduces a moving image or a still image stored in a recording medium such as a DVD (Digital Versatile Disc) and has a display capable of displaying the reproduced images) and the like. Specific examples of those electronic devices are shown in FIGS. 11A to 11H.

Figure 11A:
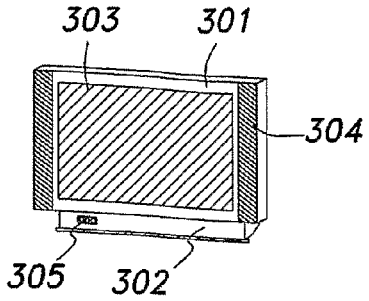
FIGS. 11A to 11H are perspective views of electronic devices to which the invention is applied.

FIG. 11A illustrates a desktop, floor standing, or wall hanging display, which includes a housing 301, a support base 302, a display portion 303, a speaker portion 304, a video input terminal 305 and the like. Such a display can be used as an arbitrary information display device such as a display for a computer, TV broadcast reception, advertisement and the like.

Figure 11B:
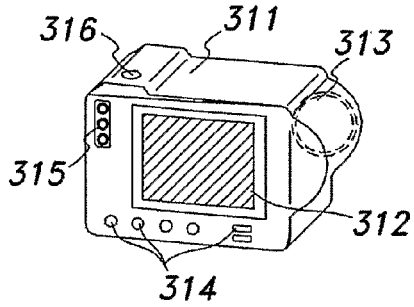

FIG. 11B illustrates a digital camera including a main body 311, a display portion 312, an image receiving portion 313, operating keys 314, an external connecting port 315, a shutter 316 and the like.

Figure 11C:
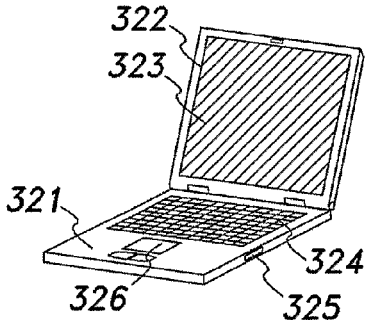

FIG. 11C illustrates a computer including a main body 321, a housing 322, a display portion 323, a keyboard 324, an external connecting port 325, a pointing mouse 326 and the like. It is to be noted that a computer includes what is called a notebook computer in which a central processing unit (CPU), a recording medium and the like are integrated, and what is called a desktop computer in which the aforementioned components are separately provided.

Figure 11D:
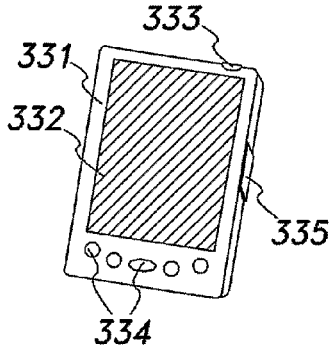

FIG. 11D illustrates a mobile computer including a main body 331, a display portion 332, a switch 333, operating keys 334, an infrared port 335 and the like.

Figure 11E:
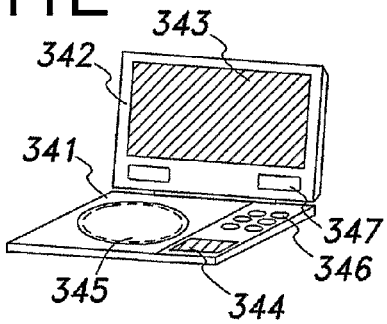

FIG. 11E illustrates a portable image reproducing device (specifically, a DVD reproducing device) provided with a recording medium, including a main body 341, a housing 342, a first display portion 343, a second display portion 344, a recording medium (such as a DVD) reading portion 345, an operating key 346, a speaker portion 347, and the like. The first display portion 343 mainly displays image data while the second display portion 344 mainly displays text data. It is to be noted that an image reproducing device provided with a recording medium includes a home game machine and the like.

Figure 11F:
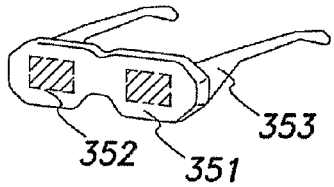

FIG. 11F illustrates a goggle type display including a main body 351, a display portion 352, and an arm portion 353.

Figure 11G:
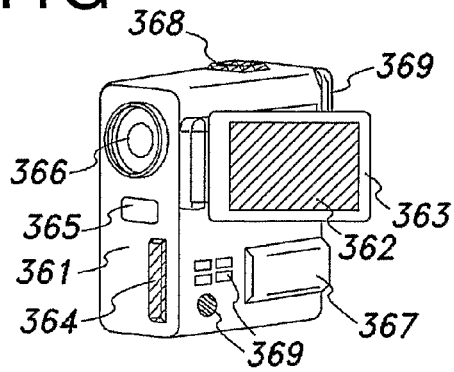

FIG. 11G illustrates a video camera including a main body 361, a display portion 362, a housing 363, an external connecting port 364, a remote control receiving portion 365, an image receiving portion 366, a battery 367, an audio input portion 368, operating keys 369, and the like.

Figure 11H:
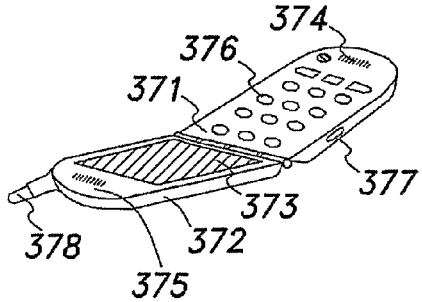

FIG. 11H illustrates a portable phone including a main body 371, a housing 372, a display portion 373, an audio input portion 374, an audio output portion 375, an operating key 376, an external connecting port 377, an antenna 378 and the like.

The display device of the invention can be applied to the display portions 303, 312, 323, 332, 343, 344, 352, 362, and 373 of the aforementioned various electronic devices. Accordingly, a compact and inexpensive memory with low power consumption and low access speed can be used as a video memory and a volatile memory, thereby a display device as a whole can be easily downsized.

It is to be noted that the invention can be applied to a display device having a light emitting element (pixel) which is deteriorated when used for a long time as well as to a display device using an EL element. The invention may also be applied to a plasma display panel (PDP) and a field emission display (FED).

Further, correction of video data for deterioration compensation of a light emitting element may be performed by multiplying video data and a deterioration coefficient by a multiplier and also by other methods such as by adding or subtracting an appropriate value to or from video data using an adder as an arithmetic circuit.

As described above, the application range of the invention is quite wide the invention and can be applied to electronic devices of various fields.

The present application is based on Japanese Priority application No. 2004-279600 filed on Sep. 27, 2004 with the Japanese Patent Office, the entire contents of which are hereby incorporated by reference.

EXPLANATION OF REFERENCE

1: display device,
2: display panel,
3: panel controller,
4: format converter portion,
5: first video memory,
6: second video memory,
7: display control portion
8 and 9: tri-state buffer,
10: selector,
11A: first video signal,
11B: second video signal,
12: counter,
13: volatile memory,
14: nonvolatile memory,
15: correction circuit,
16: correction data storing portion,
17: display device,
20: deterioration compensation circuit,
21: counter portion,
22: memory circuit portion,
23: signal correction portion,
31: display device,
32: display panel,
33: panel controller,
34: format
35: converter portion,
36: second video memory,
37: display control portion,
38: tri-state buffer,
39: tri-state buffer,
40: selector,
41: memory,
50 and 50*a*: display device,
51: display panel,
52 and 52*a*: panel controller,
53 and 53*a*: deterioration compensation circuit,
54: counter portion,
55: memory circuit portion,
56 and 56*a*: signal correction portion,
60: adder,
61: latch,
62: latch,
63: volatile memory,
64: nonvolatile memory,
64*a*: accumulated light emission time backup region
64*b*: deterioration coefficient holding region
65: adder,
66: deterioration coefficient holding register,
67: address converter portion,
68: latch,
69: latch,

70: selector,
200: substrate,
201: panel controller,
202: source signal line driver circuit,
203: gate signal line driver circuit,
204: gate signal line driver circuit,
205: pixel matrix portion (display panel),
206: deterioration compensation circuit,
208: connector,
207: flexible printed circuit (FPC)

The invention claimed is:

1. A display device comprising:
a display panel having a plurality of pixels; and
a panel controller for displaying in a predetermined digital gray scale, the panel controller comprising:
a first video memory;
a second video memory;
a format converter portion; and
a display control portion,
wherein the plurality of pixels includes a first pixel region and a second pixel region,
wherein the format converter portion is configured to convert first video data corresponding to the first pixel region into second video data and configured to write the second video data into the first video memory in a first frame period,
wherein the format converter portion is configured to convert third video data corresponding to the second pixel region into fourth video data and configured to write the fourth video data into the second video memory in a second frame period,
wherein the display control portion is configured to read out the second video data from the first video memory and configured to transmit the second video data to the display panel in the second frame period, and
wherein video data of one frame comprises the second video data and the fourth video data.

2. The display device according to claim 1, wherein the first pixel region is a single pixel region.

3. The display device according to claim 1, wherein the display device is a plasma display panel or a field emission display.

4. The display device according to claim 1, wherein the first pixel region is selected after the second pixel region is selected.

5. The display device according to claim 1, wherein the display control portion fixes video data at a fixed value in a pixel region in which the first video data is not read out from the first video memory.

6. The display device according to claim 1, the display device is driven by a time gray scale method.

7. The display device according to claim 1, wherein the display device is incorporated into an electronic appliance selected from the group consisting of a camera such as a video camera and a digital camera, a goggle type display, a navigation system, an audio reproducing device, a computer, a game machine, a mobile computer, a portable phone, a portable game machine, an electronic book, and an image reproducing device provided with a recording medium.

8. A display device comprising:
a display panel having a plurality of pixels;
a deterioration compensation circuit for correcting for a deterioration of a light emitting element in each of the plurality of pixels;
a panel controller for displaying in a predetermined digital gray scale, the panel controller comprising:
a first video memory;
a second video memory;
a format converter portion; and
a display control portion,
wherein the plurality of pixels includes a first pixel region and a second pixel region,
wherein the deterioration compensation circuit is configured to correct first video data corresponding to the first pixel region,
wherein the deterioration compensation circuit is configured to correct third video data corresponding to the second pixel region,
wherein the format converter portion is configured to convert the format of the first video data into second video data and configured to write the second video data into the first video memory in a first frame period,
wherein the format converter portion is configured to convert the format of the third video data into fourth video data and configured to write the fourth video data into the second video memory in a second frame period,
wherein the display control portion is configured to read out the second video data from the first video memory and configured to transmit the second video data to the display panel in the second frame period, and
wherein video data of one frame comprises the second video data and the fourth video data.

9. The display device according to claim 8, wherein the first pixel region is a single pixel region.

10. The display device according to claim 8, wherein the first pixel region is selected after the second pixel region is selected.

11. The display device according to claim 8,
wherein the deterioration compensation circuit comprises a counter portion for detecting accumulated light emission time of each pixel, a memory circuit portion for storing the accumulated light emission time, and a signal correction portion for correcting the first video data according to the accumulated light emission time stored in the memory circuit portion,
wherein the signal correction portion comprises a correction data storing portion for storing a correction data based on a change with time of a luminance characteristic of the light emitting element, an arithmetic circuit which applies a predetermined arithmetic operation to the first video data using the correction data stored in the correction data storing portion, and an address converter portion for reading out the accumulated light emission time and converting the accumulated light emission time into an address for accessing the correction data storing portion, and
wherein the correction data storing portion outputs the correction data according to the address to the arithmetic circuit.

12. The display device according to claim 11,
wherein the signal correction portion comprises a latch connected to an input of the arithmetic circuit, and
wherein the latch samples the first video data corresponding to the first pixel region and inputs to the arithmetic circuit.

13. The display device according to claim 11,
wherein the counter portion comprises an adder and a latch connected to an input terminal of the adder,
wherein the first video data is transmitted from the arithmetic circuit to the latch of the counter portion,
wherein the latch of the counter portion regularly samples the first video data and transmits to the adder, and
wherein the adder reads out the accumulated light emission time of the first pixel region in which the first video data is transmitted to the adder and the first video data is added to the read accumulated light emission time, thereby the accumulated light emission time is updated.

14. The display device according to claim 8, wherein the deterioration compensation circuit outputs the first video data corresponding to the first pixel region and a non-correction video data corresponding to the second pixel region to the panel controller.

15. The display device according to claim 8, the display device is driven by a time gray scale method.

16. The display device according to claim 8, wherein the display device is incorporated into an electronic appliance selected from the group consisting of a camera such as a video camera and a digital camera, a goggle type display, a navigation system, an audio reproducing device, a computer, a game machine, a mobile computer, a portable phone, a portable game machine, an electronic book, and an image reproducing device provided with a recording medium.

* * * * *